United States Patent [19]

Takata et al.

[11] Patent Number: 4,670,994

[45] Date of Patent: Jun. 9, 1987

[54] METHOD FOR HEATING A HOT AIR CIRCULATING-TYPE OF FURNACE FOR BAKING AND DRYING COATINGS ON ARTICLES

[75] Inventors: Hideyuki Takata; Yasuo Tokushima; Kaname Katoh, all of Toyota; Hideo Tachi, Aichi, all of Japan

[73] Assignees: Toyota Motor Corporation, Toyota; Trinity Industrial Corporation, Tokyo, both of Japan

[21] Appl. No.: 828,749

[22] Filed: Feb. 12, 1986

[30] Foreign Application Priority Data

Feb. 13, 1985 [JP] Japan ..... 60-24544

[51] Int. Cl.[4] ..... F26B 7/00

[52] U.S. Cl. ..... 34/39; 34/68; 118/58; 427/372.2

[58] Field of Search ..... 432/72, 59; 34/35, 86, 34/79, 39, 40, 68; 118/620, 58, 61; 427/372.2, 379

[56] References Cited

U.S. PATENT DOCUMENTS 3,917,444 11/1975 Carthew ..... 34/79

3,942,264 3/1976 Zenkner ..... 432/72

4,255,132 3/1981 Carthew ..... 432/72

*Primary Examiner*—Larry I. Schwartz

*Attorney, Agent, or Firm*—Cushman, Darby & Cushman

[57] ABSTRACT

A method of heating a drying furnace for use in hot air-circulating type coating drying in which a hot air is supplied, under circulation, to the inside of the furnace thereby heating and drying coated articles, wherein heating for the furnace is conducted through a direct heating type hot air-circulating path in which the air inside of the furnace sucked from a return duct is heated directly by a combustion gas from a burner and supplied under circulation from a supply duct again to the inside of the furnace while conducting a step of increasing the temperature by pre-heating the inside of the furnace, whereas heating for the furnace is conducted through an indirect heating type hot air circulating path in which the air inside of the furnace sucked from the return duct is heated in a heat exchanger and then supplied, under circulation, through the supply duct again to the inside of the furnace while conducting a coating drying step when the temperature inside of the furnace reaches a predetermined temperature.

12 Claims, 2 Drawing Figures

METHOD FOR HEATING A HOT AIR CIRCULATING-TYPE OF FURNACE FOR BAKING AND DRYING COATINGS ON ARTICLES

BACKGROUND OF THE INVENTION

1. Field of the Invention

This invention concerns a method of heating a drying furnace for use in hot air-circulating type drying of a coating, in which a hot air is supplied under circulation into a furnace for thereby heating and drying coated articles.

2. Description of the Prior Art

Drying furnaces for use in the coating drying mentioned above are generally classified into a direct heating type drying furnace adapted to supply combustion gases produced upon combustion of heavy oil, kerosene, city gas, liquefied propane gas and like other fuels by a burner, as they are, to the inside of the furnace, under circulation, and an indirect heating type (heat exchange type) drying furnace adapted to supply combustion gases or heat medium heated by the combustion gases from a burner to a heat exchanger for heating air and to supply the heated air, under circulation, to the inside of the furnace.

The direct heating type drying furnace is advantageous because of its extremely high heat efficiency and thus its capablility of rapidly increasing the temperature in the furnace, since the combustion gases from the burner are introduced, as they are, to the inside of the furnace. However, it has a drawback that undesired effects are caused due to impurities or the like in the quality of the coating films on the coated articles. Particularly, since combustion gases from a burner using petroleum type fuels contain a great amount of sulfur, they remarkably impair the quality of the coating films on the coated articles.

In view of the above, relatively clean fuel containing less impurity such as sulfur, for example, city gas or liquefied propane gas has generally been used in the case of a baking-finish furnace for drying a top coating (finish drying) in an automobile coating that demands an extremely high product quality.

However, as the result of experiment and study, the present inventors have found that, even when relatively clean fuel is used in a direct heating type of furnace for drying the finish on a car body, since the car body is heated to a high temperature of from about 120° to 200° C. about (usually from 150° to 160° C.), for example, in a drying furnace conducting final baking of the coating on the car body, organic solvents such as thinner and toluene, paint resins and amine compounds such as curing agent contained in the paint are evaporated in a great amount from the coating film. Then, they are thermally decomposed in direct contact with the flame of the burner and reacted with chemically active radicals formed in the combustion products such as water and nitrogen oxides (NOx) to produce tar-like substances mainly comprising deposits of low molecular weight resins, which adhere to the surface of the car body causing undesirable phenomena such as yellowing and inter-layer defoliation of the coating films.

Accordingly, in order to prevent these drawbacks inherent in the direct heating type drying furnace, it is necessary to use a burner with a high air/fuel ratio or to decrease the concentration of evaporated organic solvents or the like that lead to the formation of the tar-like substances, by increasing the amount of fresh air supplied to the inside and increasing the amount of contaminated air discharged from the inside thereof. However, this significantly increases the running cost.

On the other hand, the indirect heating type drying furnace is advantageous in that the coated articles can be isolated completely from the dust, impurities and the like produced from the combustion of the burner. Thus, the organic solvents, if evaporated from the coating film on the coated articles, are free from contact with the frame of the burner and thus produce no tar-like substances. Although this method can be considered suitable for the baking-finish of the car body or the like in this regard, the temperature increase rate is extremely low thereby requiring an extremely longer period of time for pre-heating the inside of the furnace as compared with the direct heating type drying furnace. Particularly, it is required for the drying furnace disposed in the continuous coating line of an automobile factory that the temperature can be increased to a predetermined level in a time as short as possible so as not to impair the productivity of the coating line, and this is considered to be an extremely serious drawback.

OBJECT OF THE INVENTION

In view of the above, the object of this invention is to significantly improve the product quality of coated articles without impairing the productivity of a coating line, by providing a method of heating a drying furnace for use in hot air-circulating type coating drying, which is capable of heating the inside of the furnace to a predetermined temperature in a short time by supplying a combustion gas from a burner under circulation directly to the inside of the furnace in a step where the temperature inside of the furnace is increased by pre-heating the inside thereof, and which is also capable of preventing the formation of tar-like substances (that lead to defective quality such as yellowing and inter-layer defoliation) of switching from the direct supply of the combustion gas to that of the hot air heated in a heat exchanger at a step where the temperature inside of the furnace reaches a predetermined level and coated articles such as car bodies are conveyed to the inside of the furnace.

SUMMARY OF THE INVENTION

The foregoing object can be attained by the method in accordance with this invention of heating a drying furnace for use in hot air-circulating type coating drying in which hot air is supplied, under circulation, to the inside of the furnace thereby heating and drying coated articles, wherein heating for the furnace is conducted through a direct heating type hot air-circulating path in which the air inside of the furnace sucked from a return duct is heated directly by a combustion gas from a burner and supplied, under circulation, from a supply duct again to the inside of the furnace, at a step of rising the temperature, by preheating the inside of the furnace, whereas heating for the furnace at other times, when the temperature is already at the desired level for drying coatings, is conducted through an indirect heating type hot air-circulating path in which the air inside of the furnace sucked from the return duct is heated in a heat exchanger and then supplied, under circulation, through the supply duct again to the inside of the furnace during a step when the temperature inside of the furnace has reached a predetermined temperature.

In accordance with this invention, since the combustion gas from the burner is supplied, as is, to the inside of the furnace, under circulation, to apply direct heating during the step of increasing the temperature by pre-heating the inside of the furnace, the inside of the furnace can be heated to a predetermined temperature within an extremely short period of time. Then, when the inside of the furnace reaches a predetermined temperature and the coated articles are conveyed, since indirect heating is applied, in turn, by supplying a clean hot air heated in the heat exchanger, under circulation, to the inside of the furnace, formation of tar-like substances in the furnace can be prevented, so that defective quality such as the yellowing and the inter-layer defoliation of the coating films can be prevented.

BRIEF DESCRIPTION OF THE ACCOMPANYING DRAWINGS

These and other objects and features, as well as advantages of this invention will now be described more specifically referring to preferred embodiments in conjunction with the appended drawings, wherein FIG. 1 is a flow chart of a drying furnace for use in hot air-circulating type coating drying for illustrating one embodiment of the method according to this invention; and FIG. 2 is a flow chart of a drying furnace for use in hot air-circulating type coating drying for illustrating another embodiment of the method according to this invention.

DESCRIPTION OF THE PREFERRED EMBODIMENTS

Figure 1:
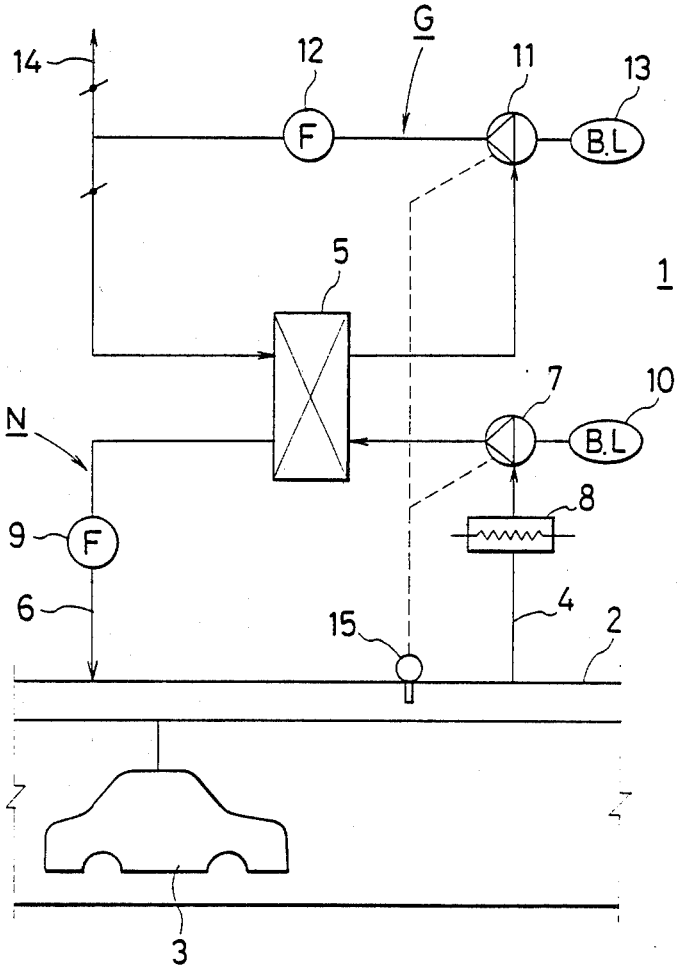

FIG. 1 is a flow sheet for a drying furnace for use in hot air-circulating type coating drying for illustrating one embodiment of the method according to this invention.

In FIG. 1, is shown a baking furnace for conducting final baking of a car coating, in which car bodies 3 as coated articles are successively conveyed at a predetermined speed by a conveyor to the inside of a tunnel-shaped furnace body 2 opened at both ends, such as a flat or angled furnace.

A hot air-circulating path N is constituted, including a route through which air inside of the furnace sucked from a return duct 4 is supplied into a combustion gas-/air heat exchanger 5, heated and then recycled again from a supply duct 6 to the inside of the furnace body 2. A burner 7 using a relatively clean fuel such as city gas or liquefied propane gas is interposed in the hot air-circulating path N.

A filter 8 for capturing dust or the like is disposed in the channel of the return duct 4 and a circulating fan 9 is disposed in the supply duct 6. A blower 10 is provided for supplying combustion air to the burner 7.

A closed combustion gas circulating path G is constituted including a route, through which a combustion gas generated from a burner 11 is supplied by means of a circulating fan 12 to aerofin tubes of a heat exchanger 5. A blower 13 is provided for supplying combustion air to a burner 14 and an exhaust duct 14 is connected to the closed combustion gas circulating path G for exhausting a portion of the combustion gas to the outside.

A control device 15 is provided, which comprises a temperature safety limit switch that generates control signals for the automatic control of the combustion in the burners 7 and 11, a temperature control potentiometer and the like.

OPERATION OF THE DRYING FURNACE

The operation of the drying furnace for use in coating having thus been constituted as shown in FIG. 1 will now be described specifically for illustrating the method of this invention.

Initially, at a step where the temperature inside of the furnace body 2 is to be increased by pre-heating the atmosphere therein upon starting the operation of the drying furnace 1, the circulating fan 9 inserted in the hot air-circulating path N is actuated and the burner 7 is ignitted. Then, the air inside of the furnace body 2 sucked from the return duct 4 is heated directly by a combustion gas from the burner 7 to a high temperature, for example, to about 300° C. Then, the heated air is introduced, together with the combustion gas from the supply duct 6, to the inside of the furnace body 2 and circulated through the path, to rapidly increase the temperature inside of the furnace by means of the direct heating system.

When the temperature inside of the furnace reaches a predetermined baking temperature, for example, from 150° to 160° C., a certain operation signal is issued from the control device 15 comprising the temperature control pontentiometer, etc., by which the combustion of the burner and the operation of the blower 10 inserted in the hot air-circulating path N are interrupted and, instead, the burner 11 disposed in the closed combustion gas circulating path G is ignitted and, simultaneously, the blower 13 and the circulating fan 12 are started.

In this way, the hot air-circulating path N is automatically switched from the direct heating system used so far, to the indirect heating system. That is, the combustion gas generated from the burner 11 of the closed combustion gas circulating path G is sent by the circulating fan 12 into the aerofin tubes of the heat exchanger 5 and, after effective heat dissipation from the aerofin tubes, circulated again to the burner 11 for heating. Meanwhile, the air inside of the furnace, at a temperature of about 150° C., is sucked from the return duct 4 by the circulating fan 9 in the hot air circulating path N, fed between the aerofin tubes of the heat exchanger 5 at a predetermined flow rate (for example, about 4 m/sec), heated to a temperature, for example, of about 170° C. while picking-up heat by means of heat exchange with the combustion gas from the burner 11 and then supplied again from the supply duct 6 to the inside of the furnace 2, under circulation.

After the drying furnace 1 has thus been switched to the indirect heating system, car bodies 3 applied with an intercoat or topcoat are conveyed to the inside of the furnace body 2, transported successively at a predetermined speed and the coating films thereby baked.

In this case, since each of the car bodies is heated to a high temperature, from 150° to 160° C., organic solvents, paint resins, amine compounds of the curing agents, etc. are evaporated from the coating films. However, since the combustion of the burner 7 disposed intermediate the course of the hot air circulating path N has already been interrupted, the evaporated organic solvents etc. are not brought into direct contact with the frame of the burner and, accordingly, do not form tar-like substances that would otherwise cause the yellowing and the inter-layer defoliation, by which the quality of the coating films on the car bodies 3 can be maintained satisfactorily.

Although the explanations have been made in the above-mentioned embodiment for the case where the combustion gas from the burner 11 is sent directly into the heat exchanger 5 for conducting the heat exchange between the combustion gas and the air, this invention is no way limited only to such an embodiment. For instance, an adequate heat medium heated by the combustion gas may be sent to the heat exchanger 5 for heating the air from inside the furnace. Alternatively, steam heated, for example, in a boiler may be sent to the heat exchanger 5 for heating the air from the inside of the furnace.

Figure 2:
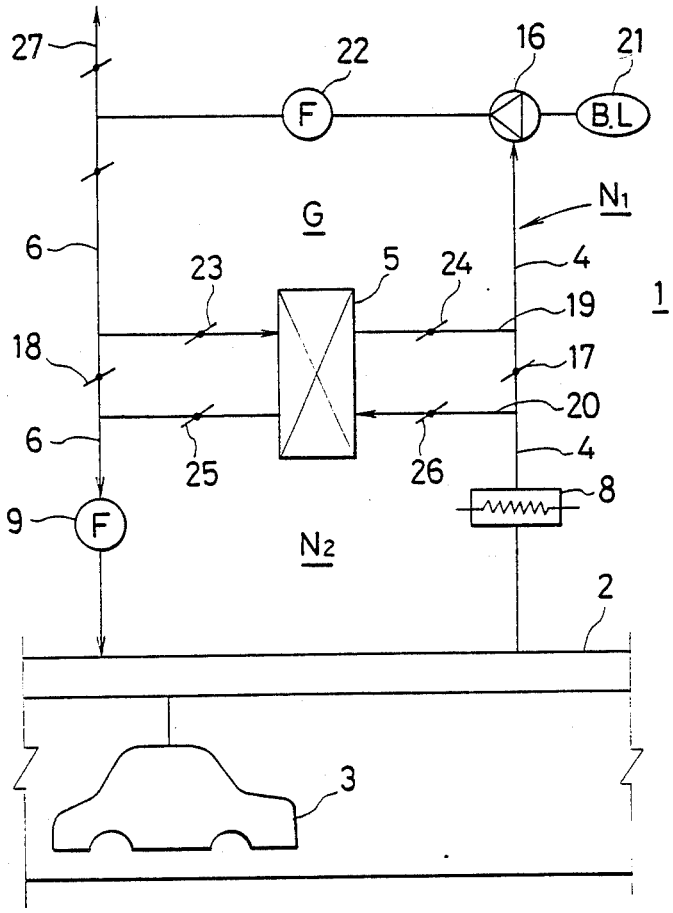

FIG. 2 shows a flow sheet of a drying furnace for use in coating drying for illustrating another embodiment of the method according to this invention. A hot air-circulating path $N_1$ of a direct heating system is constituted including a route through which the air inside the furnace body 2 sucked from a return duct 4 is heated directly by a combustion gas generated from a burner 16 and then supplied again under circulation from a supply duct 6 to the inside of the furnace body 2.

Dampers 17 and 18 for the control of flow rate or for the interruption of channels are interposed respectively in the return duct 4 and the supply duct 6. Two branch ducts 19 and 20 are connected respectively on both sides of the dampers 17 and 18 respectively in parallel with each other and between the return duct 4 and the supply duct 6, while a combustion gas/air heat exchanger 5 is disposed between the branch ducts 19 and 20. By closing both of the dampers 17 and 18, thereby separating the channels of the return duct 4 and the supply duct 6 respectively, there is established a closed combustion gas circulating path G including a route through which the combustion gas from the burner 16 is circulated from the supply duct 6 by way of the heat exchanger 5 and the return dust 19 directly to the return duct 4, as well as a indirect heating type hot air-circulating path $N_2$ including the route through which the air inside the furnace body 2 sucked from the return duct 4 is circulated through the branch duct 20 into the heat exchanger 5, where it is applied with heat through heat exchange with the combustion gas passed through the branch duct 19, and then introduced again from the supply duct 6 to the inside of the furnace body 2.

In the closed combustion gas circulating path G, there is disposed a circulating fan 22 in addition to the burner 16 supplied with the combustion air from a blower 21, so that the combustion gas from the burner 16 is sent into the aerofin tubes in the heat exchanger 5 and, after the effective dissipation of heat from the fins of the fin tubes, heated again in the burner 16 for circulation. Furthermore, dampers 23 and 24 are disposed on both sides of the heat exchanger 5 in the branch duct 19 so that the channel of the branch duct 19 can be opened or closed.

Further, in the hot air circulating path $N_2$, a filter 8 is disposed on the side of the return duct 4 while a circulating fan 9 is disposed on the side of the supply duct 6 such that the air inside the furnace sucked from the return duct 4 by the circulating fan 9 is sent by way of the branch duct 20 into the heat exchanger 5 and the hot air heated in the heat exchanger 5 is supplied, under circulation, from the supply duct 6 to the inside of the furnace. Furthermore, dampers 25 and 26 are disposed on both sides of the heat exchanger 5 to the branch duct 20 so that the flow rate of the air passing through the heat exchanger 5 may be adjusted to an optimum value (about 4 m/sec) and the channel of the branch duct 20 may be opened or closed.

Each of the dampers is adapted to be operated under automatic ON-OFF control by an actuation cylinder or a step motor operated in accordance with an operation signal issued from a temperature safety limit switch, temperature control potentiometer, etc. disposed inside of the furnace body 2, although the details for them are not illustrated.

The operation of the drying furnace for use in coating drying constituted as described above and shown in FIG. 2 will now be explained specifically for illustrating the method according to this invention.

Initially, at a step where the temperature inside of the furnace body 2 is increased by pre-heating upon starting the operation of the drying furnace, the dampers 23 and 24 disposed in the branch duct 19 are completely closed, while the dampers 25 and 26 disposed in the branch duct 20 are opened slightly by the reasons as described later. Then, the dampers 17 and 18 disposed respectively in the return duct 4 and the supply duct 6 are opened and the burner 16 and the circulating fan 9 are operated to establish a hot air-circulating path $N_1$ including a route through which the air inside the furnace sucked from the return duct 4 is heated directly by the combustion gas generated from the burner 16 and then supplied together with the combustion gas from the supply duct 6 to the inside of the furnace body 2, under circulation, thereby rapidly heating the atmosphere inside of the furnace body 2 to a predetermined baking temperature.

Then, when a predetermined baking temperature is reached, the dampers 17 and 18 are completely closed automatically to divide the passages for the return duct 4 and the supply duct 6 into two respective separated channels, while the dampers 23 and 24 and the dampers 25 and 26 disposed respectively in the branch ducts 19 and 20 are opened each to a predetermined degree to establish a closed combustion gas circulating path G and an indirect heating type hot air circulating path $N_2$, separately, instead of the hot air circulating path $N_1$ formed so far.

Thus, heating for the drying furnace 1 is automatically switched from the direct to the indirect heating system, in which the combustion gas generated from the burner 16 is circulated by the circulating fan 22 through the heat exchanger 5 and a portion thereof is exhausted externally through the exhaust duct 27 connected with the closed path G. Meanwhile, the air inside of the furnace sucked from the return duct 4 by the circulating fan 9 is supplied, under circulation, from the supply duct 6 to the inside of the fan while taking the heat in the heat exchanger 5. Since evaporation products from the furnace are merely heated indirectly in the heat exchanger 5 but not exposed to the flame of the burner 16, generation of the tar-like substances which would otherwise cause the yellowing and the inter-layer defoliation of coating films on the car bodies 3 can surely be prevented.

Incidentally, upon switching to the hot air-circulating path $N_2$ for indirect heating, the air at a relatively lower temperature remaining far inside of the branch duct 20 flows to the inside of the furnace and it may undesirably lower the temperature therein. However, if the dampers 25 and 26 disposed in the branch duct 20 are opened slightly at the initial stage of increasing the temperature inside of the furnace by pre-heating through the hot air-circulating path $N_1$, a small amount of hot air may flow previously through the channel of the circulating path $N_2$ and such a lowering in temperature can be avoided.

As described above, in the method according to this invention, since the combustion gas generated from the burner is directly supplied, under circulation, to the inside of the furnace through the direct heating type hot air-circulating path established upon increasing the temperature inside of the furnace by pre-heating, the inside of the furnace can be heated in a much shorter period of time as compared with the case of using the indirect heating type drying furnace, thereby improving the productivity of the line for producing the coated articles. In addition, since the hot air heated through the heat exchanger is supplied, under circulation, through the indirect heating type hot air-circulating path which is switched from the above-mentioned direct heating type hot air-circulating path when a predetermined temperature is reached in the furnace and the coated articles are conveyed therein, generation of the tar-like substances which would otherwise cause the yellowing or the interlayer defoliation of the coating films as experienced in the use of the conventional direct heating type drying furnace can be avoided, whereby the product quality of the coating articles can be remarkably improved. In addition, there is no more necessary in this invention to use a burner at a high air/fuel ratio or to employ large-scale ventilation equipment or the like for introducing a great amount of fresh air to the inside of the furnace and exhausting a great amount of contaminated air from the inside thereof, whereby the running cost can significantly be reduced.

What is claimed is:

1. A method for heating the atmosphere of a drying chamber of a furnace for drying in the drying chamber articles having exposed surfaces, in an instance in which matter, if entrained in the atmosphere of the drying chamber while the articles are being dried could detrimentally contaminate said surfaces, said method comprising:

(a) prior to disposing articles in said chamber for drying, raising the temperature of said chamber to a predetermined temperature, by circulating a hot combustion gas stream directly into, through and out of said drying chamber; and (b) after the temperature of said chamber has been raised to said predetermined temperature by conducting step (a), (i) discontinuing circulation of hot combustion gases directly into, through and out of said drying chamber, and, instead, (ii) heating a gas to an elevated temperature by indirect contact with a heating medium in a heat exchanger and circulating this indirectly heated gas into, through and out of said drying chamber while disposing in said drying chamber articles having said exposed surfaces.

2. The method of claim 1, wherein:

during the course of conducting step (a), at least some of the combustion gas which is circulated out of said drying chamber is recirculated to a burner as at least part of the combustion-supporting atmosphere for conducting burning of fuel in the burner, and after being resultingly transformed into hot combustion gas, is circulated as said hot combustion gas stream to said drying chamber.

3. The method of claim 2, wherein:

during the course of conducting step (b), at least some of said indirectly heated gas which is circulated out of said drying chamber is recirculated to said heat exchanger for indirect contact with said heating medium to be resultingly reheated for reuse as said indirectly heated gas.

4. The method of claim 3, wherein:

said heating medium is produced by burning a fuel in air in a heating medium-producing burner, and circulating the resultingly produced hot combustion gas stream through an opposite side of a heat exchanger from said indirectly heated gas.

5. The method of claim 4, wherein:

at least some of said hot combustion gas stream, after being circulated through said opposite side of said heat exchanger is mixed with air and recirculated to said heating medium-producing burner in which said fuel is burned.

6. The method of claim 5, wherein:

said heating medium-producing burner is said burner used for burning fuel in step (a).

7. The method of claim 1, wherein:

said articles are automobile body members bearing on said exposed surfaces coatings in need of drying.

8. The method of clam 2, wherein:

said articles are automobile body members bearing on said exposed surfaces coatings in need of drying.

9. The method of claim 3, wherein:

said articles are automobile body members bearing on said exposed surfaces coatings in need of drying.

10. The method of claim 4, wherein:

said articles are automobile body members bearing on said exposed surfaces coatings in need of drying.

11. The method of claim 5, wherein:

said articles are automobile body members bearing on said exposed surfaces coatings in need of drying.

12. The method of claim 6, wherein:

said articles are automobile body members bearing on said exposed surfaces coatings in need of drying.

* * * * *